US005985052A

United States Patent [19]

Angilella et al.

[11] Patent Number: 5,985,052

[45] Date of Patent: Nov. 16, 1999

[54] ABRASION-RESISTANT MATERIAL

[75] Inventors: Anthony G. Angilella, Richmond; Paul D. Macy, Brownsville, both of Ind.

[73] Assignee: Dana Corporation, Toledo, Ohio

[21] Appl. No.: 09/026,380

[22] Filed: Feb. 19, 1998

[51] Int. Cl.[6] ..... C21D 5/00; C22C 37/06; C22C 37/00

[52] U.S. Cl. ..... 148/321; 148/612

[58] Field of Search ..... 420/26, 13; 148/612, 148/321

[56] References Cited

U.S. PATENT DOCUMENTS

| | | | |
|---|---|---|---|
| 4,088,476 | 5/1978 | Takao et al. | 75/123 |
| 4,484,953 | 11/1984 | Kovacs et al. | 148/3 |
| 5,370,170 | 12/1994 | Sander et al. | 164/122.1 |
| 5,753,055 | 5/1998 | Liu | 148/612 |

OTHER PUBLICATIONS

Kovacs and Keough, "*Physical Properties and Application of Austempered Gray Iron*", 1994, pp. 283–291.

*Primary Examiner*—Deborah Yee
*Attorney, Agent, or Firm*—Rader, Fishman & Grauer PLLC

[57] ABSTRACT

An abrasion-resistant material is constructed from gray iron alloyed with 0.30 to 0.70% phosphorous. The high phosphorous cast iron alloy is heat treated for approximately 120 minutes to an austenitizing temperature of about 1600° F. Next, the alloy is austempered for approximately 180 minutes at about 580° F. The resulting abrasion-resistant structure is an acicular ferrite in stable austenite (ausferrite) with islands of a non-continuous, broken network of steadite of approximately 8 to 10% by volume, which has a material hardness of 280 to 330 BHN.

14 Claims, 2 Drawing Sheets

ABRASION-RESISTANT MATERIAL

FIELD OF THE INVENTION

The present invention relates to an improved cast iron material for use with machine parts for an engine. More particularly, this invention relates to an improved abrasion-resistant gray cast iron material for cylinder liners, piston rings, and the like.

BACKGROUND OF THE INVENTION

Machine parts for engines, such as cylinder liners, piston rings and the like, are made from various kinds of materials. In particular, it is known to manufacture machine parts from gray iron due to its availability, relatively low cost, its recyclability, high conductivity and low shrinkage.

Typically, the machine parts are easily centrifugally cast from gray iron and exhibit good wear resistance. However, as-cast gray iron has significant drawbacks in that it is relatively weak and brittle in tension as a result of its microstructure. Further, graphite flakes present in the microstructure tend to be sharp and pointed, leading to stress concentration points when external tensile loads are exerted on the material.

To overcome the drawbacks in as-cast gray iron, it is known to alloy gray iron with high concentrations of molybdenum and nickel to produce a bainitic microstructure with increased wear resistance. However, alloying with molybdenum and nickel is expensive.

Other known abrasion resistant materials includes a gray iron that is formed with a pearlite matrix in the microstructure. One such example of this type of microstructure includes boron in very small amounts. The boron leads to the formation of carbide having high hardness, thereby increasing abrasion resistance. However, microstructures of pearlite only achieve a material hardness in the range of 212–248 BHN Due to ever increasing production costs, there is a need for a low cost material that has significant material hardness levels and increased abrasion resistance from which machine component parts can be manufactured.

SUMMARY OF THE INVENTION

The present invention is directed to an improved abrasion-resistant material of a high phosphorous alloyed cast iron and method of making the same. The abrasion-resistant material has a microstructure with a matrix consisting of acicular ferrite in stable austenite, with a non-continuous broken network of steadite for improved wear resistance. The material exhibits a tensile strength of at least 51 ksi and a hardness level in the range of approximately 280–330 BHN.

The method for making the material comprises: (a) forming a cast iron alloy by melting an alloy consisting essentially of by weight of 3.20–3.5% Carbon, 2.0–2.5% Silicon, 0.5–1.0% Copper, 0.55–0.8% Manganese, 0.30–0.7% phosphorus, 0.2–0.4% Chromium, less than 0.5% Nickel, less than 0.12% Sulfur, with the remainder being essentially iron; (b) heating the alloy to a temperature of about 1600° F. for approximately 120 minutes to austenitize the alloy; and (c) quenching the austenitized alloy in a liquid bath, preferably a salt bath, at a temperature of about 580° F. for approximately 180 minutes to austemper the alloy.

The resulting cast iron alloy contains a microstructure matrix consisting of acicular ferrite in stable austenite with a network of broken, non-continuous steadite, wherein the network of steadite is preferably 8–10% by volume of the microstructure. The inventive microstructure exhibits a significant increase in abrasion resistance and achieves a material hardness in the range of 280–330 BHN.

Preferably, the cast iron used in the method of the present invention is a class 30 gray iron which is cost efficient and readily available, thereby advantageously reducing manufacturing costs.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

A preferred method for carrying out the invention for making a cast iron having a microstructure with the matrix thereof comprising an acicular ferrite in stable austenite with a network of broken, non-continuous steadite, involves essentially a 3-step process. The first step in the method is providing a ferrous iron melt that is alloyed with a high concentration of phosphorous, about 0.30 to 0.70% phosphorous by volume. The ferrous base material preferably is of a suitable composition to result, upon casting, in a typical class 30 gray cast iron. However, it is understood that other classes of gray iron may be used, or ferrous irons may be used.

The gray iron alloy is preferably adjusted to have approximately 3.20–3.5% carbon, 2.0–2.5% silicon, 0.5–1.0% copper, 0.55–0.8% manganese, 0.30–0.7% phosphorous, 0.2–0.4% chromium, less than 0.5% Nickel, less than 0.12% Sulfur, and the remainder being substantially iron. This composition differs from other known alloys in that the use of molybdenum, which is expensive, is eliminated and hence costs are reduced. Further, the percentage of nickel in the composition is also reduced, further adding to the reduction in costs.

The sulfur may be controlled by known means, such as using base materials that are low in sulfur, by desulphurizing the melt, or by a combination of the two. Further, any known melting unit can be used for producing the high phosphorous gray iron if appropriate control of the temperature and composition of the melt is maintained. Facilities commonly employed are: (a) cupola melting with either an acid or basic slag; (b) duplex melting in an acid or basic cupola followed by melting in an acid or basic electric arc furnace where composition adjustment is made, after which the temperature of the melt is raised for treatment with the phosphorous alloy; and (c) acid or basic electric arc melting.

Once the alloy is produced and cast, the alloy is then heat-treated to a preferable temperature of about 1600° F. for a period of approximately 120 minutes to austenitize the alloy. It is understood that the temperature and time for heat treating can vary depending on the class of gray iron and the alloy composition. The austentization step changes the microstructure of the material to a mixed phase of acicular ferrite formed in stable austenite.

Figure 1:
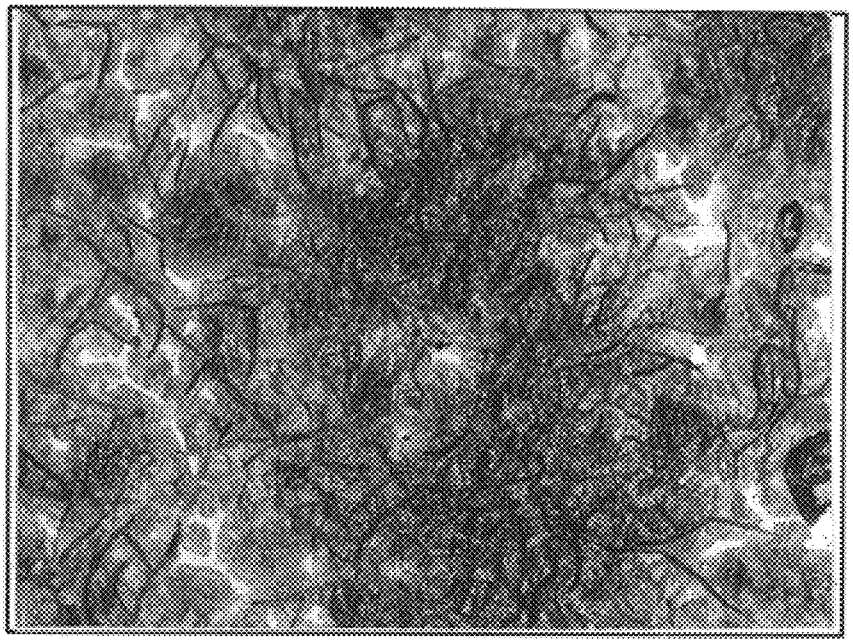
FIG. 1 is microphotograph of a high phosphorous austempered gray iron using the chemistry of the present invention (100× magnification)
Figure 2:
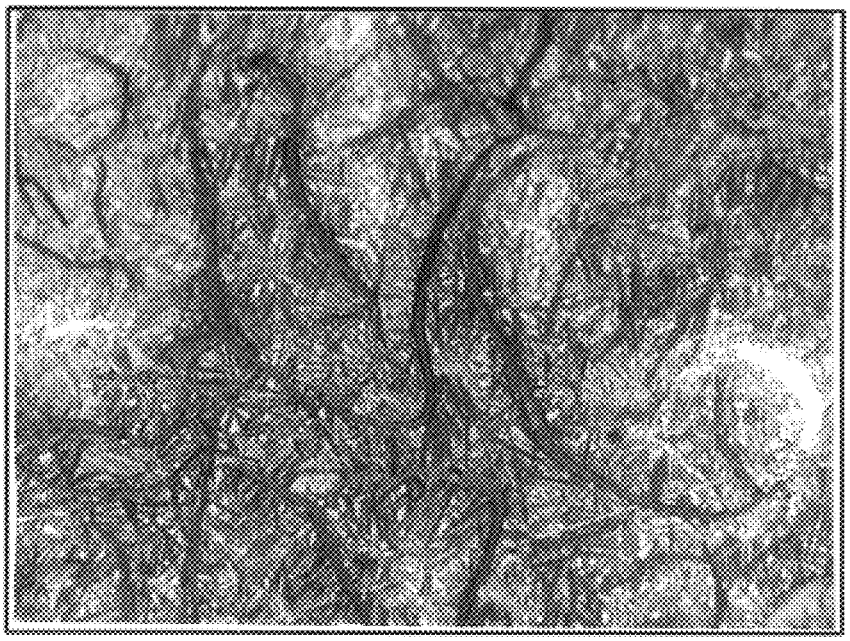
FIG. 2 is a microphotograph (500× magnification) of a high phosphorous austempered gray iron showing a micro structure of acicular ferrite in stable austenite with a broken, non-continuous network of steadite according to the present invention.

After austenitizing, the alloy is then quenched in a liquid bath, preferably a salt bath. The bath has a preferable temperature of about 580° F. and the alloy is quenched for approximately 120 minutes to austemper the alloy. As with the austenitizing step, the temperature and time for quenching can vary depending on the class of gray iron and the alloy composition. The austempering step further changes the microstructure to form a network of broken, non-continuous steadite, approximately 8–10% by volume of the microstructure. The presence of steadite offers improved wear resistance over previously known microstructures. The resulting microstructure that is formed from this process can be seen in FIGS. 1 and 2.

Figure 3:
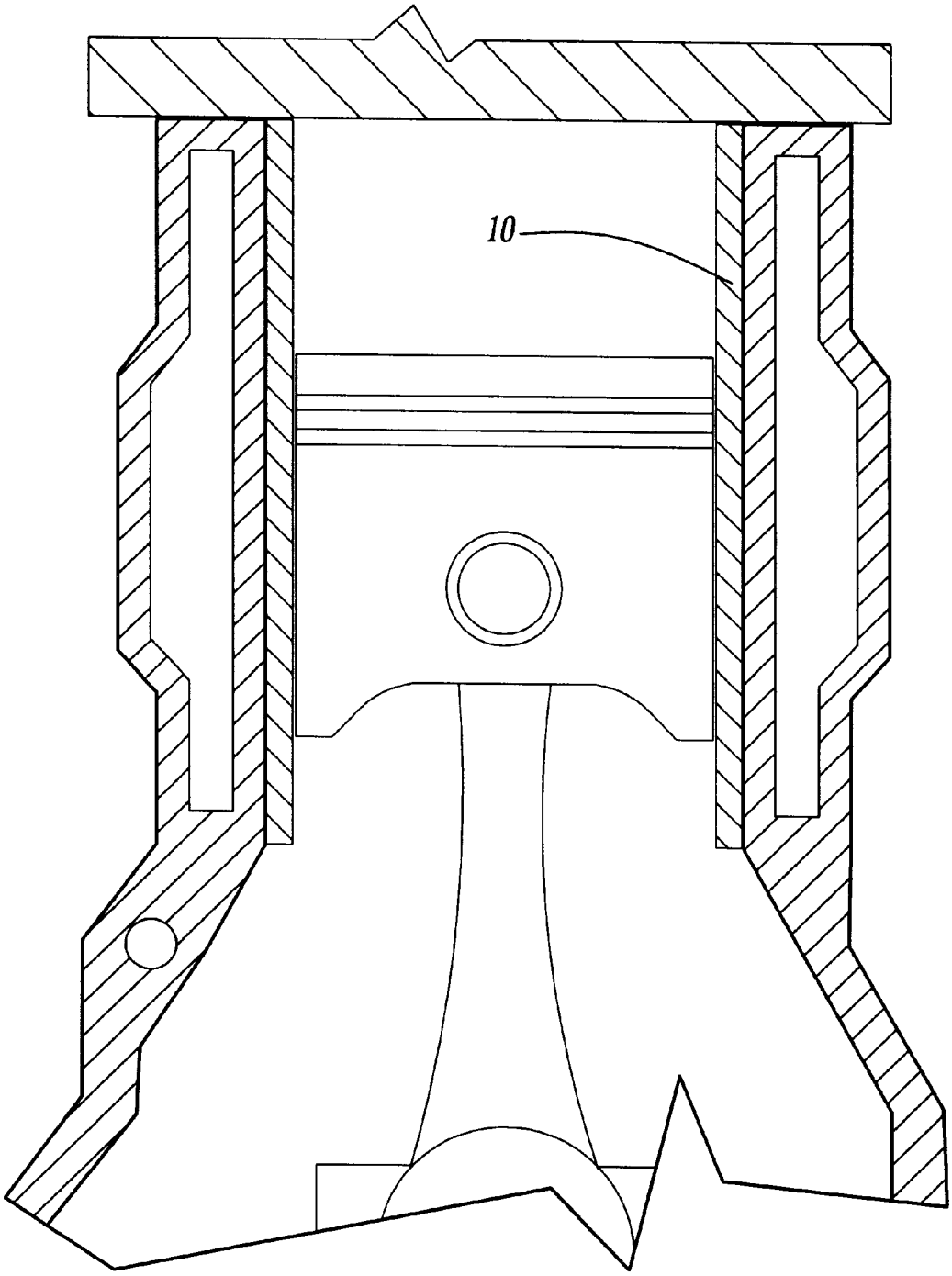
FIG. 3 is a piston ring using the material of the present invention.

The material of this invention is particularly useful for cylinder liners, piston rings 10, as seen in FIG. 3, and the like. These kinds of machine components are required to have both a high level of scuffing resistance and abrasion resistance. The resulting material exhibits a material hardness level of 280–330 BHN, a much higher range than microstructures comprised mainly of pearlite. Further. the inventive material achieves the material hardness in a more cost effective manner than in the prior art by eliminating the need for and reliance on expensive alloying agents such as molybdenum and nickel.

Preferred embodiments of the present invention have been disclosed. A person of ordinary skill in the-art would realize, however, that certain modifications would come within the teachings of this invention. Therefore, the following claims should be studied to determine the true scope and content of the invention.

What is claimed is:

1. A method of making an abrasion-resistant material having a microstructure of acicular ferrite in stable austenite with a non-continuous broken network of steadite, the steps comprising:

providing a ferrous iron;

alloying said ferrous iron with 0.30 to 0.70% phosphorus by weight to produce a cast iron alloy;

austenitizing said cast iron alloy to form an ausferritic microstructure, and austempering said cast iron alloy in a liquid salt bath to form islands of steadite within said ausferritic microstructure.

2. The method of claim 1, wherein said cast iron alloy is austenitized for approximately 120 minutes at approximately 1600° F.

3. The method of claim 1, wherein said cast iron alloy is austempered in a liquid salt bath for approximately 180 minutes.

4. The method of claim 1, wherein said cast iron alloy is austempered for approximately 180 minutes at approximately 580° F.

5. The method of claim 1, wherein said ferrous iron is alloyed with the following alloying elements and percentage content consisting essentially by weight of 3.20–3.5% Carbon, 2.0–2.5% Silicon, 0.5–1.0% Copper, 0.55–0.8% Manganese, 0.30–0.7% phosphorus, 0.2–0.4% Chromium, less than 0.5% Nickel, less than 0.12% Sulfur, and the remainder essentially iron.

6. A method of making an abrasion-resistant material having a microstructure consisting of acicular ferrite in stable austenite with a non-continuous broken network of steadite, the steps comprising:

providing a ferrous iron;

alloying said ferrous iron with 0.30 to 0.70% phosphorus by weight to form a high phosphorous cast iron alloy;

austenitizing said cast iron alloy for approximately 120 minutes at approximately 1600° F. to form an ausferritic microstructure; and austempering said ferrous iron alloy in a liquid salt bath for approximately 180 minutes at approximately 580° F. to form islands of non-continuous steadite within said ausferritic microstructure, said steadite comprising 8–10% of said ausferritic microstructure by volume.

7. An abrasion-resistant material, comprising a ferrous iron alloyed with 0.30 to 0.70% phosphorous by weight to form a high phosphorous cast iron alloy, said abrasion-resistant material having a microstructure which includes acicular ferrite in stable austenite with a network of steadite.

8. The abrasion-resistant material of claim 7, wherein said network of steadite is non-continuous and broken.

9. The abrasion-resistant material of claim 8, wherein said microstructure contains 8–10% steadite by volume.

10. The abrasion-resistant material of claim 7, wherein said abrasion-resistant material has a tensile strength in the range of approximately 51 ksi–52 ksi.

11. The abrasion-resistant material of claim 7, wherein said abrasion-resistant material has a material hardness in the range of approximately 280 to 330 BHN.

12. An abrasion-resistant material for manufacturing cylinder liners and piston rings, comprising:

a gray iron alloyed with 0.30 to 0.70% phosphorous by weight to form a high phosphorous cast iron alloy;

said cast iron alloy having a microstructure which includes:

acicular ferrite in stable austenite; and a network of non-continuous and broken steadite;

said steadite comprising 8–10% of said microstructure by volume;

said cast iron alloy having a hardness in the range of approximately 280 to 330 BHN; and said cast iron alloy having a tensile strength in the range of approximately 51 ksi–52 ksi.

13. A method of making an abrasion-resistant material having a microstructure of acicular ferrite in stable austenite with a non-continuous broken network of steadite, the steps comprising:

providing a ferrous iron;

alloying said ferrous iron with the following alloying elements and percentage content consisting essentially by weight of 3.20–3.5% Carbon, 2.0–2.5% Silicon, 0.5–1.0% Copper, 0.55–0.8% Manganese, 0.30–0.7% phosphorus, 0.2–0.4% Chromium, less than 0.5% Nickel, less than 0.12% Sulfur, and the remainder essentially iron;

austenitizing said cast iron alloy to form an ausferritic microstructure; and austempering said cast iron alloy to form islands of steadite with in said ausferritic microstructure.

14. An abrasion-resistant material, comprising a ferrous iron alloyed with the following alloying elements and percentage content consisting essentially by weight of 0.30 to 0.70% phosphorous, 3.20–3.5% Carbon, 2.0–2.5% Silicon, 0.5–1.0% Copper, 0.55–0.8% Manganese, 0.2–0.4% Chromium, less than 0.5% Nickel, less than 0.12% Sulfur, and the remainder essentially iron to form a high phosphorous cast iron alloy, said abrasion-resistant material having a microstructure which includes acicular ferrite in stable austenite with a network of steadite.

* * * * *